US007345590B2

(12) United States Patent
Nakano et al.

(10) Patent No.: US 7,345,590 B2
(45) Date of Patent: Mar. 18, 2008

(54) WIRELESS TERMINAL WITH GAS LEAKAGE DETECTION FUNCTION, GAS LEAKAGE DETECTION SYSTEM USING THE SAME, AND GAS LEAKAGE NOTIFICATION METHOD

(75) Inventors: Sadaki Nakano, Kokubunji (JP); Koichi Yokosawa, Kokubunji (JP); Yasushi Goto, Kokubunji (JP)

(73) Assignee: Hitachi, Ltd., Tokyo (JP)

( * ) Notice: Subject to any disclaimer, the term of this patent is extended or adjusted under 35 U.S.C. 154(b) by 166 days.

(21) Appl. No.: 11/181,928

(22) Filed: Jul. 15, 2005

(65) Prior Publication Data

US 2006/0114114 A1 Jun. 1, 2006

(30) Foreign Application Priority Data

Nov. 26, 2004 (JP) ..... 2004-342242

(51) Int. Cl.
*G08B 17/10* (2006.01)

(52) U.S. Cl. ..... 340/632; 340/539.26; 73/31.02

(58) Field of Classification Search ..... 340/632, 340/539.26; 73/31.02
See application file for complete search history.

(56) References Cited

U.S. PATENT DOCUMENTS 6,252,510 B1 6/2001 Dungan
6,670,887 B2 * 12/2003 Dungan ..... 340/632
6,794,991 B2 * 9/2004 Dungan ..... 340/632
7,020,562 B2 * 3/2006 Lillis et al. ..... 340/632
2001/0040509 A1 11/2001 Dungan

FOREIGN PATENT DOCUMENTS

| | | |
|---|---|---|
| EP | 0 751 488 | 1/1997 |
| JP | 06-252928 | 9/1994 |
| JP | 08-046633 | 2/1996 |
| JP | 10-320675 | 12/1998 |
| JP | 11-306463 | 11/1999 |
| JP | 2001-077819 | 3/2001 |

* cited by examiner

*Primary Examiner*—John Tweel, Jr.
(74) *Attorney, Agent, or Firm*—Antonelli, Terry, Stout & Kraus, LLP.

(57) ABSTRACT

In a hydrogen gas station where a great number of sensors are installed, in case hydrogen leakage occurs, sensors in the vicinity of the leakage location start to transmit a warning to an access point all at once. This causes channel capacity saturation and failure to transmit a warning to the access point. Nodes and the access point are connected to each other by an uplink channel and a downlink channel. The access point detects congested/uncongested status of the uplink channel by using a wireless transmitter module and notifies the nodes of the congested/uncongested status of the channel by means for transmitting onto the downlink channel. Meanwhile, each node controls its transmission operation, according to the hydrogen concentration level detected by its hydrogen sensor and the uplink channel congested/uncongested status notified from the access point. In this way, channel overflow due to access congestion in case of hydrogen leakage can be prevented.

7 Claims, 11 Drawing Sheets

FIG. 9

SPECIFIC GRAVITY COMPARISONS OF FUEL GASES

| GAS TYPE | SPECIFIC GRAVITY TO AIR (AIR=1.00) |
|---|---|
| GASOLINE | 2.95 |
| BUTANE | 2.00 |
| PROPANE | 1.52 |
| NATURAL GAS | 0.65 |
| HYDROGEN | 0.07 |

WIRELESS TERMINAL WITH GAS LEAKAGE DETECTION FUNCTION, GAS LEAKAGE DETECTION SYSTEM USING THE SAME, AND GAS LEAKAGE NOTIFICATION METHOD

CLAIM OF PRIORITY

The present application claims priority from Japanese application JP 2004-342242 filed on Nov. 26, 2004, the content of which is hereby incorporated by reference into this application.

FIELD OF THE INVENTION

The present invention relates to wireless terminals for gas leakage detection, a system using such terminals and a gas leakage notification method. In particular, the invention relates to wireless terminals, a system using such terminals, and a gas leakage notification method for safe and low-cost operation of a hydrogen gas station to supply motor vehicles with high-pressure hydrogen gas.

BACKGROUND OF THE INVENTION

Recently, hydrogen energy attracts attention as clean fuel substituting for fossil fuel. As an example of application of hydrogen energy to motor vehicles, there is a fuel-cell electric vehicle which is driven by electric power generated by fuel cells mounted on it, wherein the fuel cells generate electric power by electrochemical reaction of hydrogen and oxygen in air. Hydrogen in gaseous state is stored in a high-pressure container which is mounted on the vehicle. Also, a hydrogen gas vehicle equipped with an internal combustion engine in which hydrogen gas from the high-pressure container storing the hydrogen gas is combusted is being developed.

Hydrogen is an explosive gas that is colorless and odorless. To use hydrogen more safely, a hydrogen gas station to supply motor vehicles with hydrogen gas must be provided with a set of functions to prevent explosive accidents, including detecting gas leakage quickly, notifying its manager of danger, and shutting off the gas at the main valve.

For conventional hydrogen gas stations, several sensors for detecting hydrogen gas have been installed per station.

Meanwhile, Japanese Patent Laid-Open No. H10(1998)-320675 encloses a wireless warning system that detects leakage of gas, electricity, or water at home and wirelessly transmits leakage information.

Japanese Patent Laid-Open No. H11(1999)-306463 encloses a gas leakage warning system oriented to city gas. This patent document describes a technique of setting up alternate routes to ensure a bandwidth for communications, that is, a system in which, when a wireless communication channel is occupied by a particular sensor and unavailable for other sensors, communication to an idle access point is attempted.

Since hydrogen is an explosive gas that is colorless and odorless, there are a number of problems to be solved for its practical use. For instance, to set up hydrogen gas stations at suitable places in an urban area, allowing motor vehicle users to get hydrogen gas supply with ease, it is needed to ensure high safety. Thus, it is conceivable to detect hydrogen leakage with high precision by installing dozens of sensors per hydrogen gas station.

In general, installing a great number of hydrogen sensors involves a problem of cost for cable placing and installation.

As described in Japanese Patent Laid-Open No. H10(1998)-320675, wireless communication between sensors (with warning means) and an access point (with network control means) is favorable for reducing the cost.

However, wireless communication bandwidth is narrower than wired communication bandwidth and high reliability of wireless communication is hard to ensure. Because dozens of sensors are necessary per station, if hydrogen gas stations are set up in an urban area, a sufficient bandwidth must be allocated to a wireless communication channel to avoid channel overflow even in a case where simultaneous communication from all sensors occurs and this is considered to require a lot of cost.

A problem specific to hydrogen gas is that the diffusion speed of hydrogen gas is faster than that of other gasses. If hydrogen leakage occurs in a hydrogen gas station where a great number of sensors are installed and wirelessly connected, it is supposed that all sensors in the vicinity of the leakage location begin to transmit information of an abnormality to an access point all at once. Particularly because hydrogen is a gas with the smallest molecular weight, once it leaks out, it diffuses in a moment, faster than other gasses, and activates all sensors in the vicinity of the leakage location.

As a result, it is expected that congested access from sensors more than the allowable number may take place, causing the wireless channel to overflow. The channel overflow may give rise to the worst case where shut-off valves are not actuated due to failure of transmission of warning to the access point in spite of hydrogen leakage detected by the sensors.

A solution to this problem is allocating a bandwidth that allows for simultaneous communication from all sensors to the wireless channel in advance.

Also, it is conceivable to use the method of setting up access points for alternate routes in preparation for saturated communications, as described in Japanese Patent Laid-Open No. H11(1999)-306463. However, for a system like the hydrogen gas station where almost all sensors start to transmit a warning simultaneously when gas leakage occurs, a great number of access points for alternate routes are required and a very high cost is required to realize the system.

SUMMARY OF THE INVENTION

An object of the present invention is to provide wireless terminals with gas leakage detection functions, a gas leakage detection system using such terminals, and a gas leakage notification method, satisfying both a requirement to ensure the safety of a hydrogen gas station with a greater number of sensors installed at the station and a requirement to reduce the system cost for installing the sensors and allocating communication channels.

A typical aspect of the invention disclosed herein will be briefly summarized below.

A wireless terminal of the present invention has a sensor, a microcomputer, and a wireless transceiver and is provided with a transmitting function to transmit outward gas concentration detected by the sensor through the wireless transceiver. The wireless terminal includes a transmission control unit to control a transmission process of the gas concentration through the wireless transceiver over a communication channel, according to the level of the gas concentration detected at the wireless terminal. A threshold of detected gas concentration to determine whether gas concentration notification is transmitted is set, so that wireless terminals at which gas concentration sensed by the sensor is less than the threshold defer their transmissions and, consequently, higher concentration gas information provided by sensors can be transmitted to the access point.

When transmitting the gas concentration through the wireless transceiver, the wireless terminal of the present invention controls the transmission process of the gas concentration, according to the level of the gas concentration and the busy ratio of the communication channel over which it will transmit. By dynamically varying the threshold of detected gas concentration to determine whether gas concentration is transmitted, preferential transmission of information from the sensors detecting higher concentration gas to the access point can be performed without saturating the channel capacity.

According to the present invention, even if a great number of sensors, for example, hydrogen sensors, employed in a wireless communication system, are installed, the number of sensors from which information should be transmitted can be dynamically controlled, according to the channel status. Therefore, gas leakage can be detected with high precision and reliably. Thus, gas supply facilities like hydrogen gas stations can be installed in an urban area or the like where high safety is required.

A great number of sensors, for example, hydrogen sensors can be installed in a hydrogen gas station or the like at low cost. Logically, an infinite number of sensors can be placed in one hydrogen station.

BRIEF DESCRIPTION OF THE DRAWINGS

FIG. 9 shows a comparison table of specific gravities of fuel gasses.

DETAILED DESCRIPTION OF THE PREFERRED EMBODIMENTS

Figure 1:
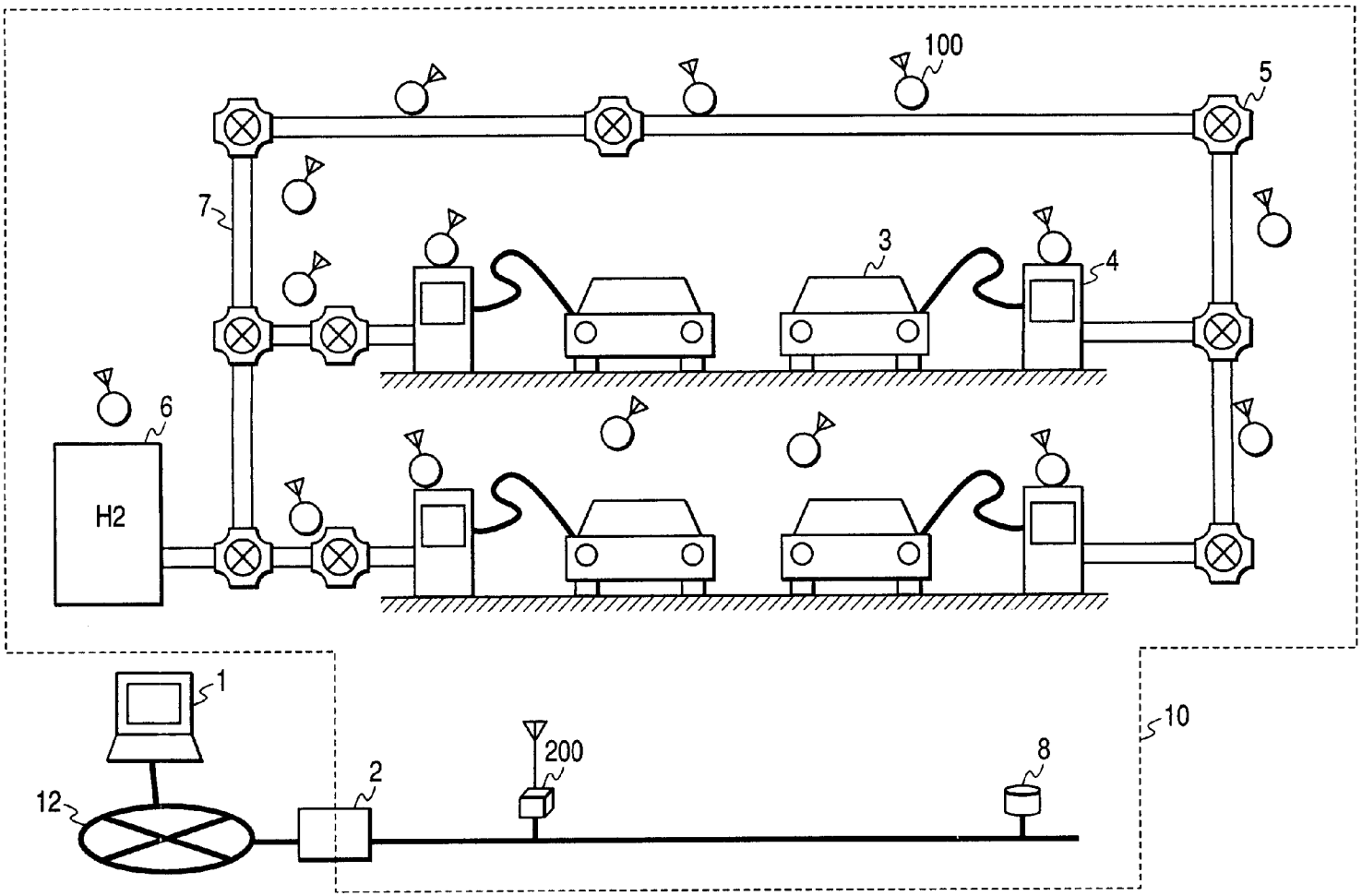
FIG. 1 is a conceptual diagram showing one embodiment of a hydrogen gas station involved in the present invention.

The gist of the present invention is to control transmissions from sensors, according to gas concentrations detected by the sensors and congested/uncongested status of a wireless channel. Embodiments of the present invention applied to a hydrogen gas station will be described hereinafter.

High-pressure gas that is supplied at the hydrogen gas station of the present invention is not only hydrogen gas and may also be a flammable gas such as Compressed Natural Gas (CNG). Hereinafter, the gas simply refers to hydrogen gas to simplify explanation.

In the event that gas leakage occurs in the hydrogen gas station of the present invention, some sensors located in the vicinity of the leakage location detect high concentration gas and the gas concentration detected by other sensors becomes smaller gradually as the sensor position becomes more distant from the leakage location.

Estimation of the gas leakage location is performed, based on information from the sensors detecting higher concentration gas. Thus, if the communication channel capacity is finite, the transmissions from the sensors detecting lower concentration gas are deferred, so that information from the sensors detecting higher concentration gas will be more likely to arrive at an access point.

Specifically, a threshold of gas concentration to be detected is set. If gas concentration detected by a sensor is less than the threshold, the sensor will not transmit notification of gas leakage detected by it. In consequence, information from the sensors detecting higher concentration gas can be transmitted to the access point. Moreover, the threshold is varied dynamically, according to the channel busy ratio. This enables preferential transmission of information from the sensors detecting higher concentration gas to the access point without saturating the channel capacity.

In a concrete configuration of communications, a plurality of gas sensors and an access point are connected to each other by two channels, namely, uplink channel and downlink channel. The uplink channel is chiefly used for each sensor to notify the access point of abnormality and the downlink channel is used for the access point to control each sensor. A general control flow of the system is as follows.

The access point monitors traffic on the uplink channel to determine congested/uncongested status of the uplink channel. The access point takes a channel busy ratio measurement on the uplink channel at given intervals and broadcasts the channel busy ratio over the downlink channel. Having detected gas leakage, each sensor receives the uplink channel busy ratio broadcasted over the downlink channel before transmitting notification.

The threshold of detected gas concentration by which each sensor determines whether to transmit notification is set in direct proportion to the uplink channel busy ratio. That is, when the channel busy ratio is large, the threshold is set high; when the channel busy ratio is small, the threshold is set low. For example, if the channel is about to overflow, the channel busy ratio becomes so large and the threshold is set higher accordingly. Most of the sensors will not transmit notification as the gas concentrations detected by them are less than the threshold. In consequence, the channel busy ratio decreases and the channel overflow is automatically avoided.

In this way, each sensor operates according to the above control flow. Consequently, traffic throughout the system is always controlled to fall within an optimum range and transmission of information from only the sensors detecting higher concentration gas to the access point will take place without saturating the channel capacity.

Embodiments of the present invention, which will be described below, are regarded as best modes for compatibly fulfilling contradictory requirements to ensure the safety of the hydrogen gas station with a great number of sensors installed at the station and to reduce the cost for installing the sensors and allocating the communication channels.

Now, illustrative first and second embodiments will be described.

First Embodiment

FIG. 1 is a conceptual diagram showing one embodiment of a hydrogen gas station involved in the present invention. The hydrogen gas station 10 is a facility for supplying fuel-cell vehicles 3 with hydrogen, which is suitably located along a road in an urban area or a suburb and equipped with wireless terminals 100 with gas leakage detection functions. A plurality of hydrogen gas stations 10 are placed under monitoring by a terminal 1 at a supervisory center established in a fire station, security company, and the like.

Hydrogen gas stored in a hydrogen gas reservoir 6 at each hydrogen gas station 10 flows through piping 7 to hydrogen dispensers 4 from which it is supplied to a high-pressure container in a fuel-cell vehicle 3 powered by hydrogen gas. Hydrogen gas is stored in the hydrogen gas reservoir 6, compressed at high pressure, for example, 35 MPascal or more, and charged into the high-pressure container in the vehicle by pressure difference. Fuel cells mounted on the vehicle 3 generate electric power by taking advantage of electrochemical reaction of the hydrogen supplied from the high-pressure container and oxygen in air extracted from ambient air and the electric power is used to run the motor for driving the vehicle.

In each hydrogen gas station 10, a great number of wireless terminals (hereinafter, simply referred to as nodes) 100 with gas leakage detection functions to detect gas leakage are installed just in case of gas leakage near the branches and joints of the piping 7 or around the hydrogen gas dispensers 4 and at other locations. For example, dozens of nodes with built-in sensors are installed in one hydrogen gas station. In each hydrogen gas station 10, one access point 200 provided with a control program is installed. To ensure higher safety, a plurality of access points 200 may be installed in each hydrogen gas station 10.

Shut-off valves 5 are installed at all critical points along the piping 7 in the hydrogen gas station 10. Normally, control of the shut-off valves 5 is automatically performed by the control program in the access point 200.

Each node 100 is equipped with a wireless transceiver so that it will transmit notification of abnormality in case of gas leakage occurring to the access point 200, using the wireless transceiver. Upon receiving the notification of abnormality from each node 100, the access point 200 stores the abnormality-related information into a large-capacity storage device and has a function to forward the notification to the terminal 1 at the supervisory center via an Internet network 12 to which the access point is connected via a broadband router 2.

When the terminal 1 at the supervisory center receives the notification of abnormality from the access point 200 within the hydrogen gas station 10, the personnel of the security company or fire station can view and investigate the state of the hydrogen station through a web camera 8 remotely from the terminal 1, estimate the gas leakage location, based on notification records stored in the large-capacity storage device within the access point 200, or issue an evacuation advisory.

In the meantime, control of the shut-off valves 5 in occurrence of gas leakage is automatically performed by the control program in the access point 200. Control of the shut-off valves 5 can be performed from the remote terminal 1 as well.

Figure 2:
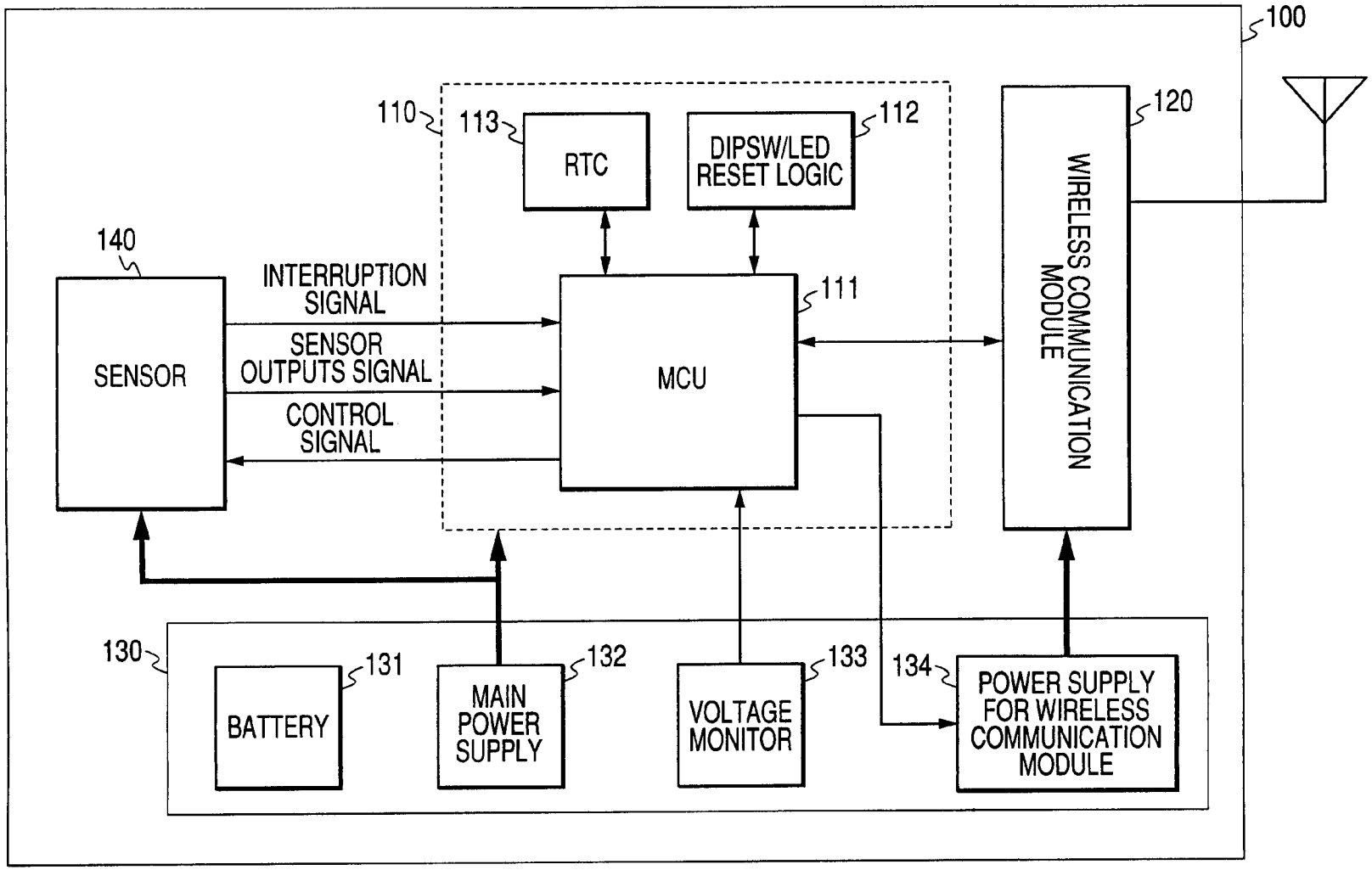
FIG. 2 is a block diagram of anode installed in the hydrogen gas station of FIG. 1.

FIG. 2 is a block diagram of a node 100 installed in a hydrogen gas station 10 of FIG. 1. The node 100 is composed of a node control unit (microcomputer) 110, a wireless communication module (wireless transceiver) 120, a power supply unit 130, and a sensor unit 140.

The node control unit 110 is composed of an MCU (micro controller) 111 as a core which controls overall operation of the node 100, a real time clock controller (RTC) 113, and other miscellaneous circuits 112. The node control unit (microcomputer) 110 has a communication control function to control wireless communication between the node 100 and the access point 200 under the control of the control program and an equipment control function to control the shut-off valves 5 under a command from the host device.

The MCU 111 is usually placed in standby mode, controlled to minimize battery power consumption. Standby mode refers to the state when only the sensor operates. The MCU goes out of standby mode by an interrupt signal that is issued at given intervals from the RTC 113 or an interrupt signal that is issued from the sensor 140. The former interrupt signal is a regular communication signal and its main role is periodically reporting to the access point 200 that the node operates normally. The interval period of this signal can be set by DIPSW included in the miscellaneous circuits 112. On the other hand, the latter interrupt signal is issued by the sensor 140 when the sensor 140 detects an abnormal value of gas and is an important signal that acts as a trigger to report abnormality to the access point 200.

The wireless module 120 is, for example, a wireless transceiver classified under the category of specified low power radio stations prescribed in Japanese Radio Law. It has transmitting and receiving functions and specifications, a communication range of 100 m and a communication rate of about 4800 bps. The specifications of this wireless module 120 are appropriately set, based on a region where the node is installed and local regulations. Moreover, the wireless module 120 has a function of allowing the operation switching one transmitting/receiving frequency band to another, a function of checking whether a radio frequency channel for transmission is idle, that is a carrier sense function. The control unit 110 can wirelessly communicate with the access point 200 via the wireless module 120.

The power supply unit 130 is composed of a battery 131, a main power supply 132, a voltage monitor 133, and a power supply for wireless communication module 134. All the power for the node 100 is supplied from the battery 131. The power supply separates into two paths, a first power supply path to supply power from the battery 131 via the main power supply 132 to the control unit 110 and the sensor 140 and a second power supply path to supply power from the battery 131 via the power supply for wireless communication module 134 to the wireless communication module 120.

The first power supply path always supplies power. The second power supply path is configured so that it can be on/off controlled from the MCU 111 and is controlled to be on only when wireless communication takes place via the wireless communication module 120. The voltage monitor 133 has a function to notify the control unit of how the battery is consumed and is used in particular when information of remaining battery power is communicated to the access point.

A hydrogen sensor is mounted on the sensor 140. As an example, the hydrogen sensors detect a hydrogen concentration in atmospheric air reaching about 100 PPM or higher as an abnormal value. The sensor 140 and the MCU 111 are connected by three lines: a line over which an interrupt signal Int is sent and received; a line over which sensor output Sout, an analog voltage representing a sensed value is sent and received; and a line over which a control signal Cs to control the sensor is sent and received. The control signal Cs is used to switch one measurement mode of the hydrogen sensor to another in this embodiment. More specifically, this signal is used to switch between a mode in which high precision hydrogen measurements are made with more power consumed and a mode in which rough measurements are made with low power.

While the node 100 of this embodiment is used for the purpose of detecting hydrogen gas, it is designed so that it can control the shut-off valves on the piping by a command wirelessly received from the access point by replacing the hydrogen sensor that is attached to the sensor 140 unit with a valve open/close control module.

Figure 3:
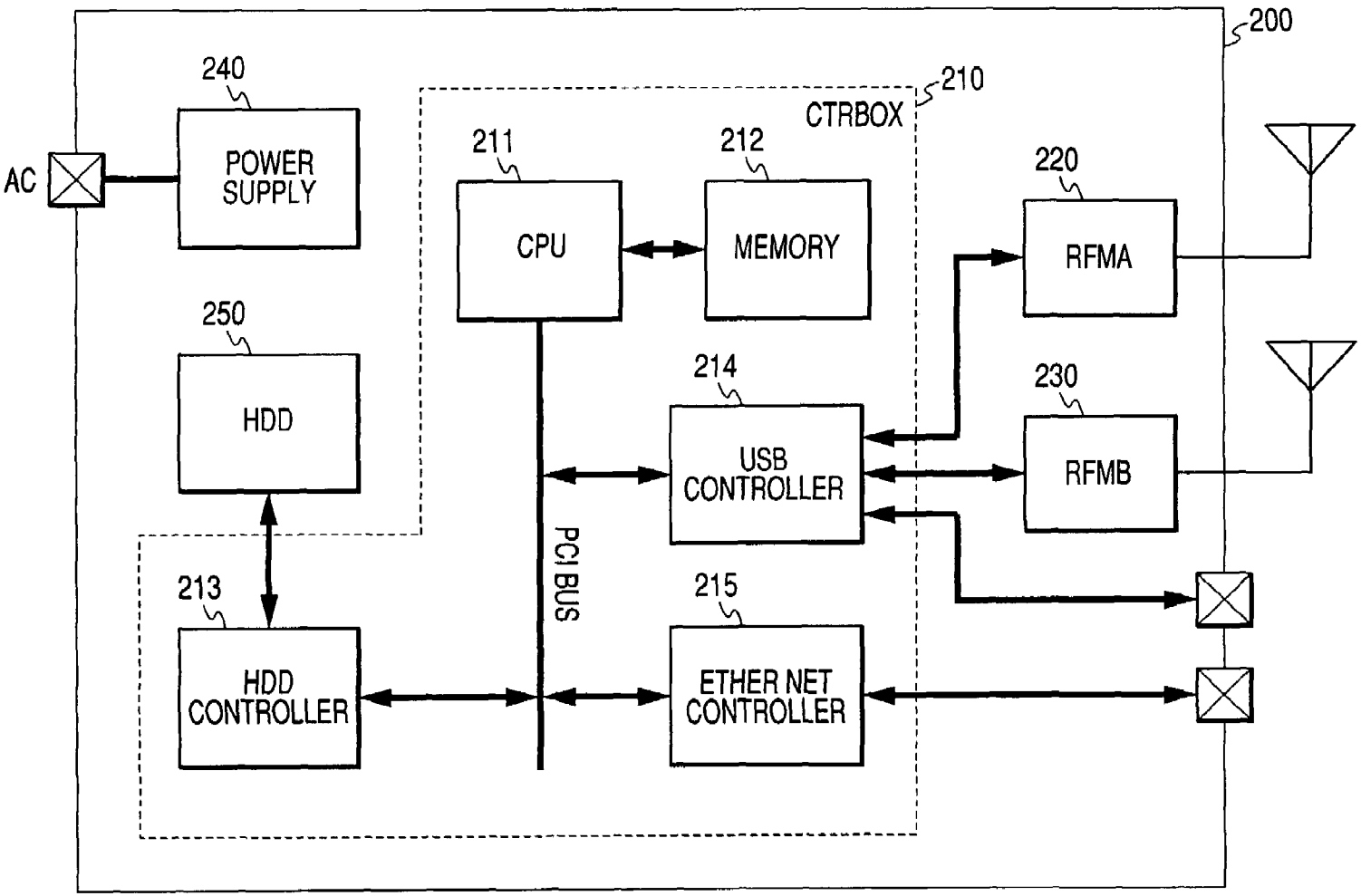
FIG. 3 is a block diagram of an access point installed in the hydrogen station of FIG. 1.

FIG. 3 is a block diagram of the access point 200 installed in the hydrogen station 10 involved in the present invention. The access point is composed of the following interconnected elements: a power supply 240; a large-capacity storage device (HDD) 250; a CTRBOX 210 having a function equivalent to a computer for control; and a wireless transmitter module RFMA 220 and a wireless receiver module 230 which have functions equivalent to the wireless communication module 120.

A microcomputer 211 is built in the CTRBOX 210 and a memory 212 is connected to its memory bus, while an HDD controller 213, a USB controller 214, and an Ethernet controller 215 are connected to the PCI bus (Ethernet is a registered trademark of Xerox Corporation). The microcomputer 211 in the CTRBOX 210 has a communication control function to control wireless communication between each node 100 and the access point 200 and wired communication between the access point 200 and the terminal 1 under the control of the control program and an equipment control function to make each node 100 control the shut-off valves 5.

As an OS, Linux is installed on the access point 200 for control of the HDD controller 213, USB controller 214, and Ethernet controller 215 and other control tasks and web server, database, and other applications can run on it.

Figure 4:
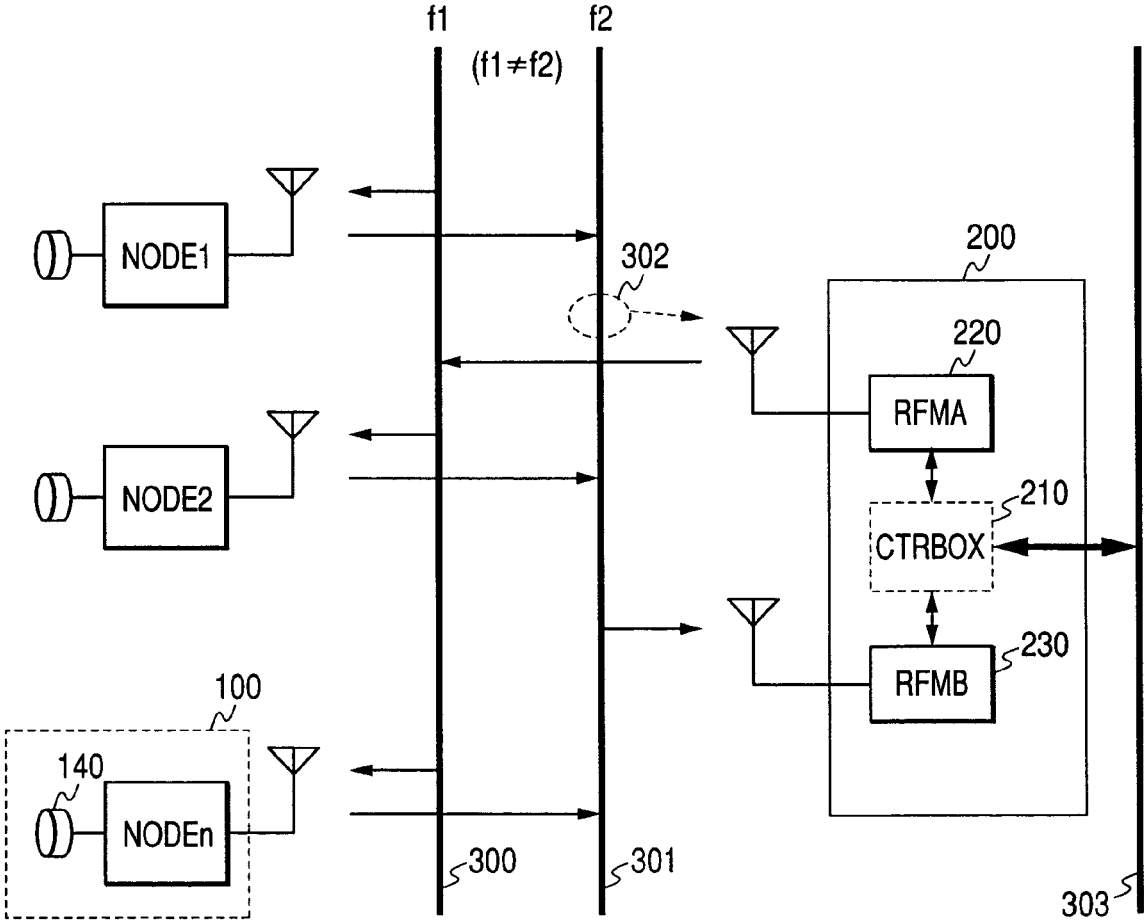
FIG. 4 shows wireless connections between each node and the access point.

Next, the communication control function of the node control unit (microcomputer) 110 will be described. FIG. 4 depicts wireless connections between each node 100 and the access point 200.

Wireless communications between each node 100 and the access point 200 are performed using a node control channel 300 and a transmission channel from node 301. Separate radio frequencies are assigned to the channels 300 and 301 so that both radio channels and frequency bands do not interfere with each other. That is, a radio frequency f1 of the channel 300 and a radio frequency f2 of the channel 301 are different. If a plurality of access points 200 are installed in each hydrogen gas station 10, separate frequencies are assigned to both channels per access point 200.

Each node 100 performs communication, using the channel 300 for receiving only and the channel 301 for transmitting only. The communication includes a regular reporting mode to report the status of each node 100 at intervals of about one hour and an abnormal reporting mode to report the status of each node 100 upon the occurrence of abnormality. Because the transmitting channel 301 is shared across the plurality of nodes, especially when two or more nodes transmit at the same time during the abnormal reporting mode, a communication collision occurs and makes correct information transmission impossible. To avoid such communication collision as much as possible, each node checks whether the channel over which it will transmit is idle by carder sensing before transmission and initiates communication at timing to avoid a collision as much as possible. As in this case, control to avoid a collision between transmissions from a plurality of nodes is generally called CSMA/CA. Carrier sense refers to a means for detecting whether a radio frequency band is being used.

The receiving channel 300 is shared across the plurality of nodes as is the case for the transmitting channel 301. However, because these nodes are controlled to entirely receive over this channel, this channel is free from a collision which would occur on the channel 301.

Next, the access point 200 will be further explained. The access point 200 includes the RFMA 220 and RFMB 230 wireless modules. The RFMA 220 and RFMB 230 are radio modules having identical specifications, but their roles are different. The RFMB 230 is used as a receiver only for the purpose of keeping monitoring the channel 301 over which warning is transmitted.

The RFMA 220 is used as a carrier sensor to determine the busy ratio of the channel 301 and as a transmitter to transmit a packet in which the channel busy ratio is embedded onto the channel 300.

The busy ratio of the channel 301 is derived from results obtained by detecting whether a carrier (the dotted circle 302) is present on the channel 301 repeatedly at given intervals.

In the meantime, the RFMA 220 also has a function to transmit one of various commands that may be generated in the CTRBOX 210 in accordance with a request received over the wired network 303 or a result received by the RFMB 230 onto the channel 300.

Figure 5:
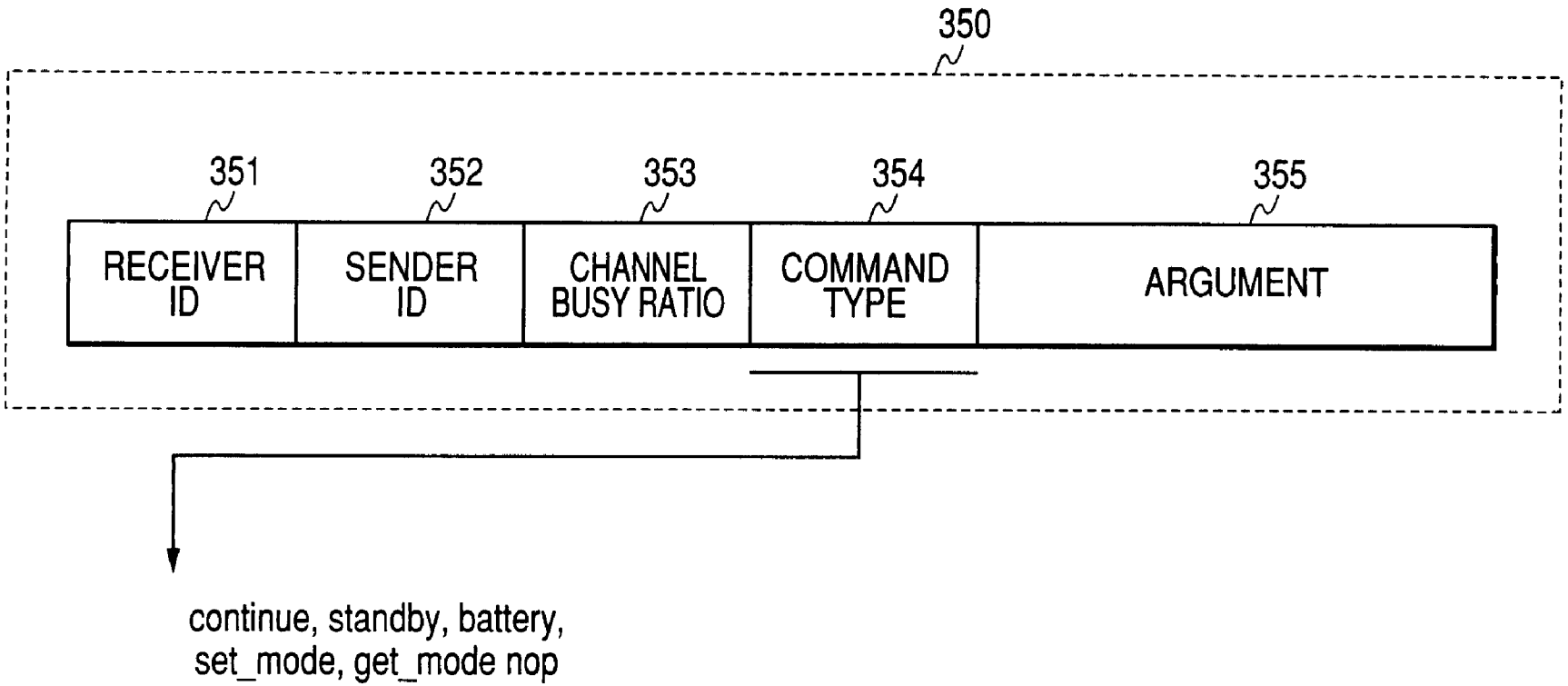
FIG. 5 shows the structure of a packet that is transmitted and received by communication between each node and the access point.

FIG. 5 shows the structure of a packet that is transmitted and received by communication between each node 100 and the access point 200.

The packet 350 is made up of the following fields: receiver identifier 351 to identify the receiver of the packet; sender identifier 352 to identify the sender of the packet; channel busy ratio 353 in which the channel busy ratio of the channel 301 is stored; command type 354 specifying a command issued to the receiving node; argument 355 in which an argument of the command is stored. The command type 354 field contains one of different commands to request various actions. Specifically, the following commands are defined.

"continue"—Continue monitoring. Report the status again after the elapse of seconds specified by the argument.

"standby"—Change to standby state.

"battery"—Report the battery remaining power.

"set_mode"—Set sensor mode (either high precision mode or low power consumption mode)

"get_mode"—Report sensor mode (either high precision mode or low power consumption mode)

"nop"—No action requested (this is used when the channel busy ratio is broadcasted).

Figure 6:
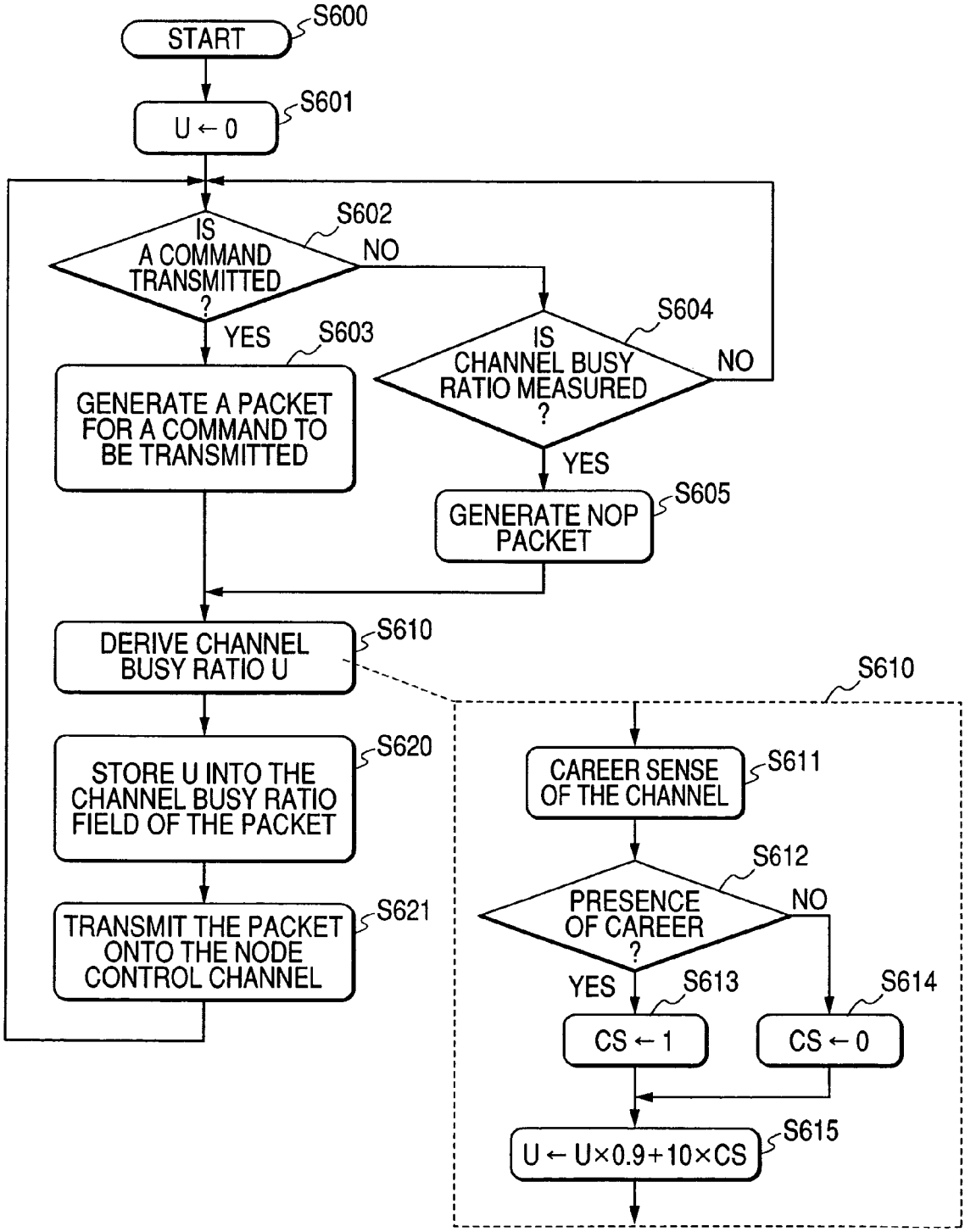
FIG. 6 shows a flowchart of operation of the access point that determines the busy ratio of the transmission channel from node and transmits this information onto the node control channel.

FIG. 6 shows a flowchart of operation of the access point that determines the busy ratio of the transmission channel from node and transmits this information onto the node control channel. Using this figure, a method of deriving the busy ratio of the channel 301 by the microcomputer on the access point 200 and the flow of transmitting the busy ratio onto the channel 300 will be explained.

After start (S600), first, a variable U representing the busy ratio is initialized to 0 (S601). U assumes a value in a range from 0 to 100 which is the greatest busy ratio.

Then, it is determined whether there is a command to be transmitted over the channel 301 (S602). If this decision is true, a packet for the command to be transmitted is generated (S603). If there is no command to be transmitted, the next decision step determines whether to measure the channel busy ratio (S604). The channel busy ratio is measured 10 times per second, i.e., at intervals of about 100 ms. This decision determines whether 100 ms has passed after the last measurement of the channel busy ratio. If this decision is true, an NOP packet is generated (S605). The NOP packet is defined as follows: a packet in which "nop" (no operation) is specified in the command type 354 field and a node that received this packet does no action other than copying the value contained in the channel busy ratio 353 field into the node's memory.

Next, an algorithm (S610) for deriving the channel busy ratio U adopted in this embodiment will be explained.

First, sensing the carrier 302 shown in FIG. 4 is performed and a successful result is the carrier sensed CS (S611).

A new channel busy ratio U is derived by adding the carrier sensed CS to the previous channel busy ratio U multiplied by 0.9, as in an equation below. If the carrier sensed is added, a constant of 10 is used; if no carrier has been sensed, a constant of 0 is used (S612 to S615).

$$U=U\times 0.9+10\times CS$$

When this algorithm S610 is used, if carriers are sensed successively, U will approximate to almost 100. Conversely, if no carrier is sensed again and again, U will approximate to almost 0. U assumes a value in the range from 0 to 100.

The above formula of calculating the channel busy ratio U is an example and it goes without saying that the formula may be replaced with another one based on the same concept.

The access point 200 stores the value of U derived by the algorithm (S610) into the channel busy ratio 353 field in the packet (S620) and transmits the packet onto the channel 300 (S621), thus notifying each node 100 of the busy ratio of the channel 301. A series of operations described above is performed by using the wireless module RFMA 220 on the access point 200.

In the hydrogen gas station where a great number of nodes 100 are installed, in case leakage of hydrogen gas occurs, nodes 100 in the vicinity of the leakage location start to transmit warning to the access point all at once, signaled by the sensors 140 mounted on the nodes.

Figure 7:
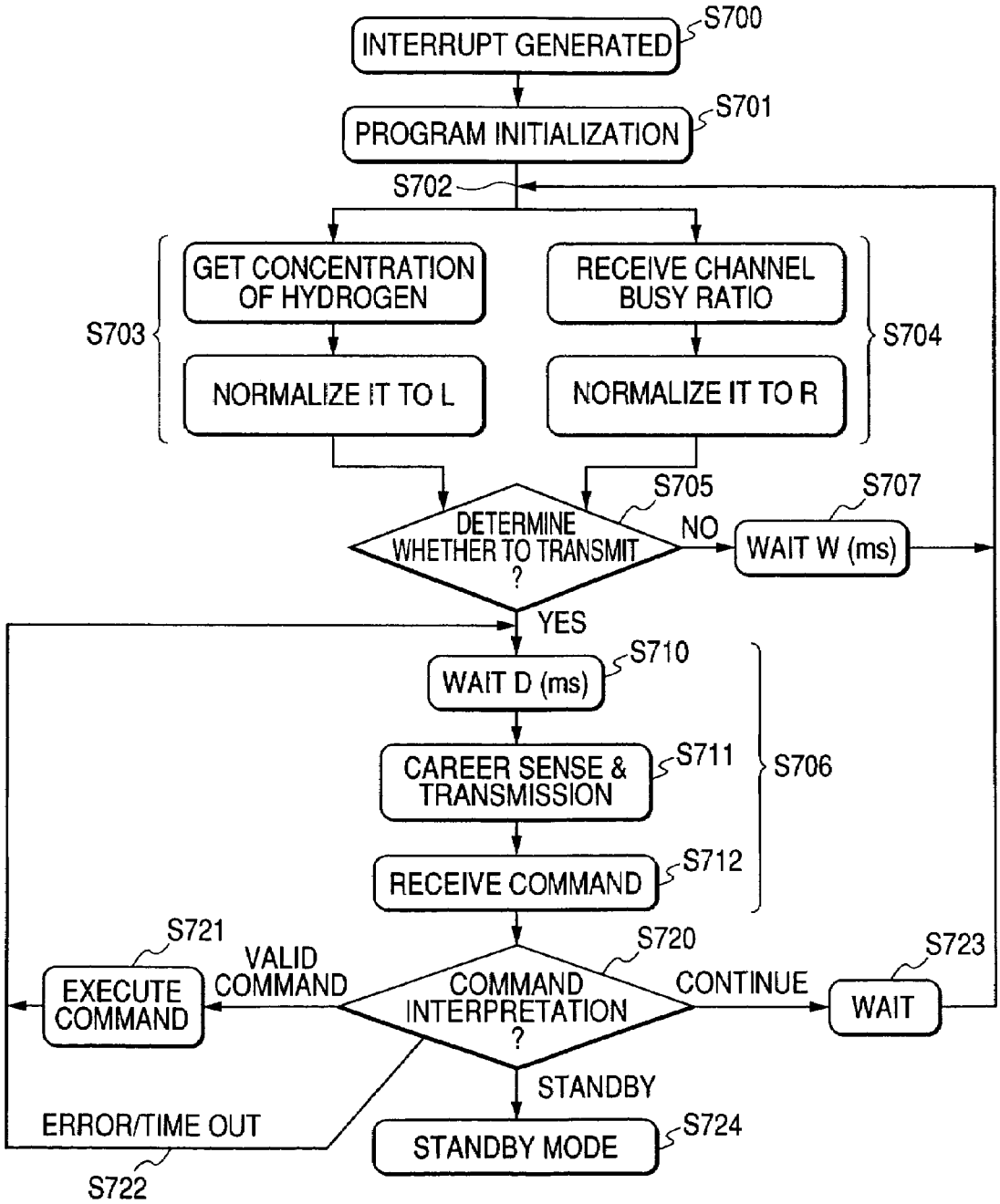
FIG. 7 shows a flowchart of operation of a node that controls transmission, based on the value sensed by the sensor and the channel busy ratio.

FIG. 7 is a flowchart of operation of a node that controls transmission, using the value sensed by the sensor 140 and the channel busy ratio. Using FIG. 2 and FIG. 7, this flowchart will be explained in detail.

The sensor 140 on the node 100 generates an interrupt when it detects gas leakage (S700), which activates the MCU 111 of the microcomputer. Upon being activated, the MCU 11 initializes the program (S701), and the procedure goes to the entry to decision (S702). Here, in preparation for transmission, receiving a packet 350 transmitted on the radio channel 300 is tried and information L sensed by the sensor is obtained (S703). That is, the node 100 gets the concentration of hydrogen gas leaked from the sensor 140. The concentration value is normalized to a hydrogen concentration level L in the range from 0 to 100. In parallel with the above, the node 100 turns on the power supply for wireless communication module 134 and activates the wireless communication module 120.

In the meantime, the node 100 receives the packet transmitted on the channel 300, gets the channel busy ratio U of the channel 301 from the channel busy ratio 353 field of the packet, and normalizes it to a channel busy ratio R in the range from 0 to 100 (S704).

Using the hydrogen concentration level L and the channel busy ratio R, thus obtained, the node then determines whether to transmit (S705), based on a criterion pattern for transmission decision which is given in advance.

The step of determining whether to transmit S705 will be explained in detail with FIG. 8.

Figure 8:
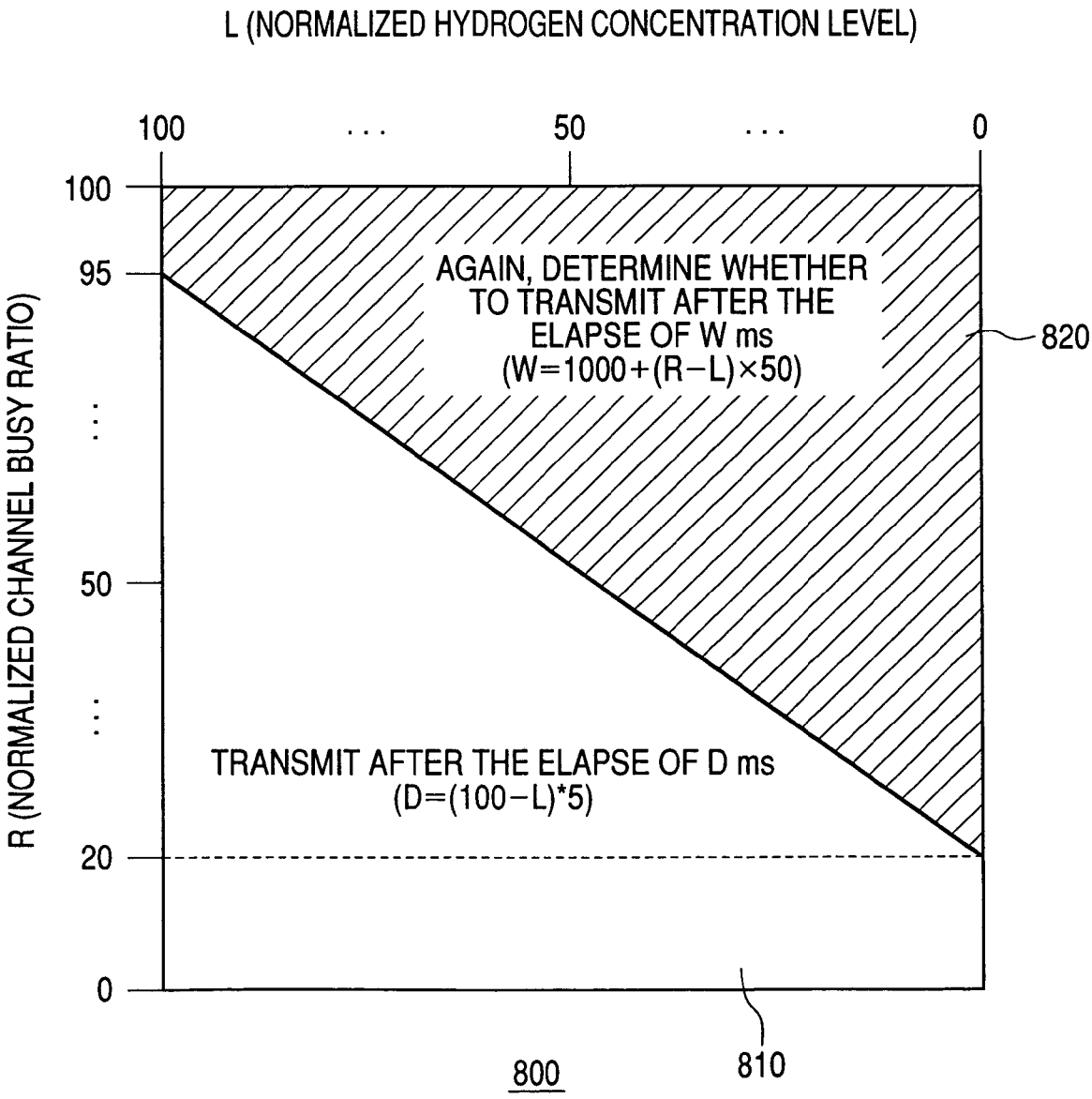
FIG. 8 is a graph to explain how to determine whether to transmit for transmission control, based on the value obtained by the sensor and the channel busy ratio.

FIG. 8 shows an example of the criterion pattern for transmission decision 800 by which transmission is controlled, or whether to transmit is determined, based on the hydrogen concentration level L and the channel busy ratio R.

In the criterion pattern for transmission decision 800 of FIG. 8, the ordinate represents normalized channel busy ratio R and the abscissa represents normalized hydrogen concentration level L. Normalized values R and L fall within the range from 0 to 100; the greater the value, the higher will be the channel busy ratio or the hydrogen concentration level. As for the channel busy ratio R, values of 20% and below absolutely fall in a region 810 in the light of the fact that the need for limiting channel use is reduced in the low region of channel busy ratio R. On the other hand, values of 95% and above absolutely fall in a region 820, because, when the channel busy ratio R is seriously high, still giving the node the chance of using the channel increases confusion and such status is hard to control. In this case, transmission from the node is deferred to wait until the channel busy ratio R decreases less than 95%.

In the step of determining whether to transmit S705, if the point at which L and R meet falls within the region 810, it is regarded as true; if the point falls within the region 820, it is regarded as false. If the result of the decision is true, the procedure goes to the transmission flow (S706) and the node is controlled to transmit after the elapse of D milliseconds. If, on the other hand, the result of the decision is false, transmission from the node is deferred (S707) and it is determined again whether to transmit after the elapse of W milliseconds.

Time periods to wait, denoted by D and W, are used for the purpose of deliberately shifting transmission timing so that a plurality of nodes do not start to transmit synchronously at the same time. The higher the hydrogen concentration detected at the node, the times to wait for that node are set shorter.

The criterion pattern for transmission decision 800 of FIG. 8 is just one example and its form is not-so limited. The line separating the criterion pattern for transmission decision 800 into two regions may be set appropriately as a function f (R, L) for channel busy ratio R and hydrogen concentration level L or a function including another element added to R and L.

Returning to FIG. 7, explanation will be continued.

If the result of determining whether to transmit (S705) is false, after a wait for the time (W millisecond) described in FIG. 8, the procedure returns the entry to decision (S702) and the step of determining whether to transmit S705 is executed again.

If the result of the decision is true, the procedure goes to the transmission flow (S706) and, after a wait for the time (D millisecond) described in FIG. 8, goes to a carrier sense step (S711). Here, before transmission, the node checks whether the channel 301 is idle by carrier sending and performs transmission. If the channel is busy, the node repeats carrier sensing several times until the channel becomes idle. If the channel is still busy, the procedure goes to an error processing routing, which is not shown in FIG. 7, and appropriate processing is performed.

Having received transmission from the node, the access point transmits a packet onto the channel 300 to notify the sender node that receiving has been done properly.

The node receives the packet (S712), interprets the command in the packet (S720), and executes the action specified in the command type 354 field within the packet (S721).

Specifically, if the command type 354 field contains "continue," which commands the node to continue monitoring the hydrogen concentration, the node waits for time (S723) specified in the argument 355 field within the packet and then returns to the entry to decision (S702) to measure the hydrogen concentration again and determine whether to transmit to the access point. If the command type 354 field contains "standby," this command is issued from the access point when the report is erroneous or when the leakage has already been calmed and recovery of safety verified. When having received this command, the node changes to standby mode (S724). Moreover, there is a special command that requests a return of the result of the command execution to the access point, like "battery" specified in the command type 354 field. Having received this command, the node measures the battery remaining power, returns to the beginning of the transmission flow (S706), and transmits that information to the access point (S711). Otherwise, if an error or receiving timeout occurs, the node returns to the beginning of the transmission flow (S706) and executes retransmission.

Then, abnormality information from the node is forwarded from the access point 200 to the terminal 1 at the supervisory center or the like connected to the Internet. Upon receiving abnormality notification on gas leakage from the access point, personnel at the supervisory center estimates the gas leakage and directs the hydrogen gas station that necessary countermeasures should be taken or notifies the departments concerned of the gas leakage.

Because the estimation of the gas leakage location is performed, based on information from the sensors detecting higher concentration gas, if the capacity of the communication channel is finite, the transmissions from the sensors detecting lower concentration gas are deferred, so that information from the sensors detecting higher concentration gas will be more likely to arrive at an access point.

Therefore, even in case of emergency of gas leakage occurring, proper communication between the nodes in the hydrogen gas station where the gas leakage has occurred and the access point 200 is ensured and this makes it possible to notify the terminal at the supervisory center of the location of the hydrogen gas leakage very quickly.

According to this embodiment of the present invention, safer use of high-pressure hydrogen gas is possible, despite that the diffusion speed of hydrogen gas is faster than that of other gasses. This respect will be explained with FIGS. 9 and 10.

FIG. 9 is a table listing the specific gravities of fuel gasses relative to air. Gasoline, butane, and propane tend to settle down because they are heavier than air, whereas natural gas and hydrogen tend to diffuse upward because they are lighter than air. Especially, hydrogen is highly diffusive as its specific gravity is one fourteenth of air. Meanwhile, at hydrogen gas stations now in practical use, hydrogen gas is stored, compressed at as high pressure as 35 MPascal and charged into vehicles by pressure difference. Furthermore, hydrogen gas is said to be compressed at higher pressure up to 70 to 90 MPascal in future, because it is required to increase continuous mileage of vehicles powered by hydrogen.

Therefore, if hydrogen gas leaks out of one place of the piping and gas supply system in a hydrogen gas station 10, it is anticipated to happen that leaked hydrogen gas spreads widely across the hydrogen gas station 10 at quite a high speed and almost all sensors start to transmit simultaneously. Even in such a case, it is necessary to make it possible to ensure proper communication between each node and the access point 200 in the hydrogen gas station, notify the terminal at the supervisory center of the location of hydrogen gas leakage as soon as possible and to take quick countermeasures, for example, closing the shut-off valves 5 in the location of the leakage.

Figure 10:
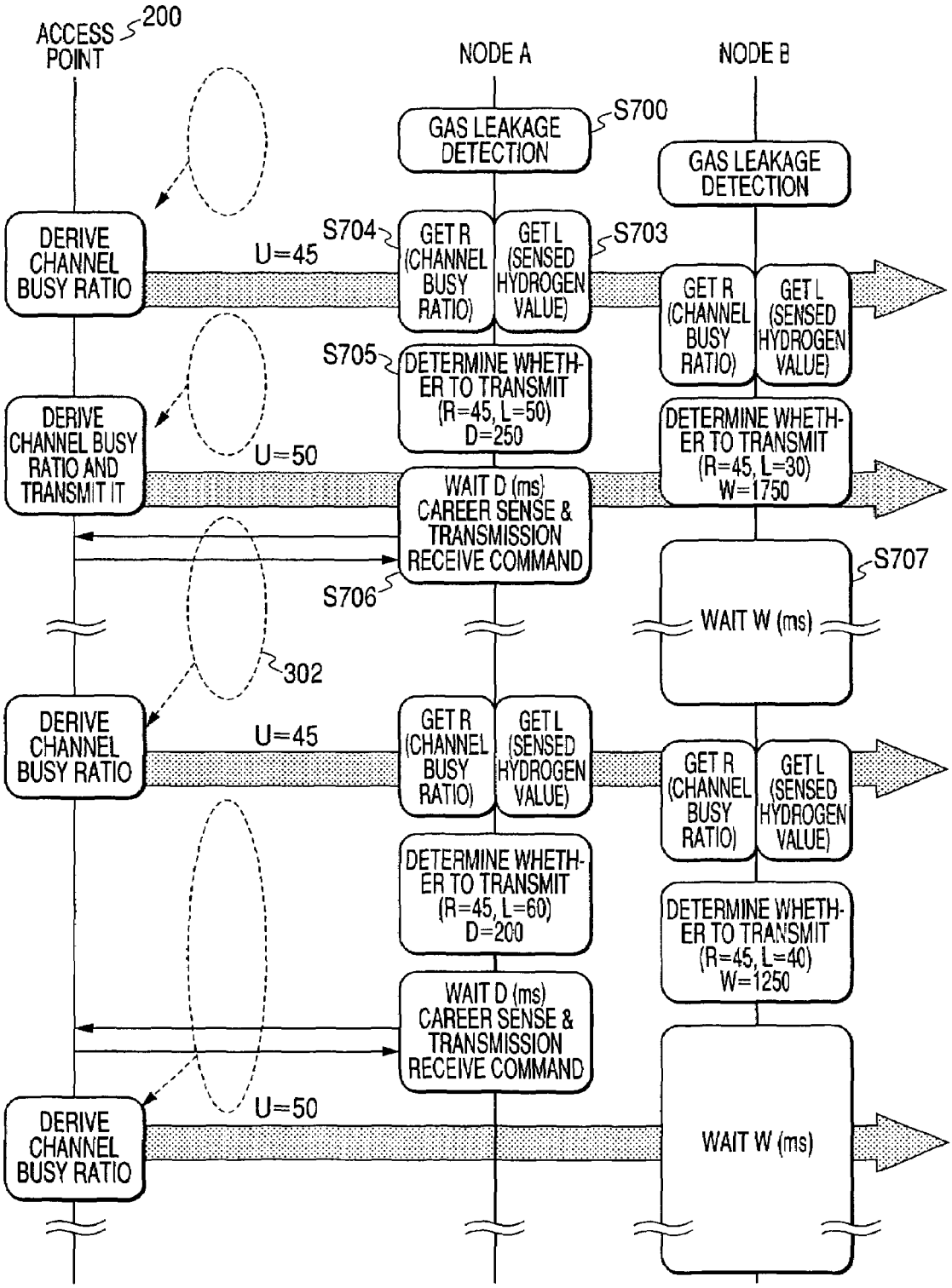
FIG. 10 shows an example of how a plurality of nodes and the access point operate in emergency.

FIG. 10 shows an example of how a plurality of nodes and the access point operate in emergency.

The following description assumes, as an example, a situation where hydrogen leaks out of a location in a hydrogen gas station where an access point and a plurality of nodes are installed.

FIG. 10 describes the operations of a fifth closest node to the leakage location (node A) and a tenth closest node to the leakage location (node B) among the plurality of nodes installed. Operation steps (S700 to S707) described in FIG. 10 correspond to the operation steps (S700 to S707) in FIG. 7.

According to the flowchart of FIG. 6, the access point 200 performs carrier sensing on the channel 301 at give intervals, derives the channel busy ratio U, embeds it into a packet, and transmit the packet onto the channel 300. Transmission of the channel busy ratio is always output at given intervals, regardless of whether or not hydrogen leakage occurs.

In case hydrogen leakage occurs, the sensors detect abnormality and the nodes transmit the abnormality to the access point in order of closest to the leakage location. When the node A detects the hydrogen leakage, the nodes closer to the leakage location has already transmitted the abnormality and, thus, the channel busy ratio U for communication is 45.

In the meantime, the node A detects the gas leakage, obtains the channel busy ratio R and the hydrogen concentration level L, and determines whether to transmit for transmission control, according to the flowchart of FIG. 7. At the node A, by way of example, R=45 and L=50 are obtained, the result of the decision is true, and transmission is performed after the elapse of D=250 milliseconds.

After the transmission, the node A receives a "continue" command which commands the node to continue monitoring. Thus, it reports the sensed hydrogen concentration again after the elapse of a given time.

After the second report from the node A, R=45 and L=60 are obtained. Thus, the result of the decision is true and transmission is performed after the elapse of D=200 milliseconds. Difference from the first report is that wait time D is shorter, due to higher concentration hydrogen detected.

On the other hand, after a while since the node A detects the hydrogen leakage, the node B, the tenth closest one to the leakage location, also detects the hydrogen gas leakage. At the node B also, the same operations take place, according to the flowchart of FIG. 7. At the node B, by way of example, R=45 and L=30 are obtained and the result of the decision is false. In consequence, transmission from the node B is deferred and the node B is controlled so that it is determined again whether to transmit after the elapse of W=1250 milliseconds. In this example, even after the second decision where R=45 and L=40, transmission is deferred again.

As described above, according to the present embodiment, gas leakage in a hydrogen gas station is detected quickly and proper communication in which priority is given to more urgent transmissions can ensured. Consequently, hydrogen can be utilized more safely. In other words, the number of sensors whose sensed information should be transmitted can be controlled dynamically depending on the channel status and, therefore, logically, an infinite number of sensors can be placed in one hydrogen station. As a result, hydrogen gas leakage can be detected with high precision and reliably and hydrogen gas stations can be installed in an urban area or the like where high safety is required. A great number of sensors can be installed in a hydrogen gas station at low cost.

As another effect of the feature that a great number of sensors can be installed, more exact and real-time monitoring of gas leakage status can be performed. Consequently, detailed control including forced evacuation of gas and shutting off the gas valves can be performed and the safety and convenience of hydrogen gas stations are enhanced.

The hydrogen gas station of the present embodiment is provided with a set of functions including detecting gas leakage quickly, notifying the manager of danger, and shutting off the gas at the main valve and allows for safe utilization of hydrogen.

Second Embodiment

In the first embodiment, the method of controlling transmissions according to hydrogen concentration information provided from the sensors and the channel busy ratio has been described. In second embodiment, an instance where transmissions are controlled, using only hydrogen concentration levels provided from the sensors, without using the channel busy ratio, is described.

Figure 11:
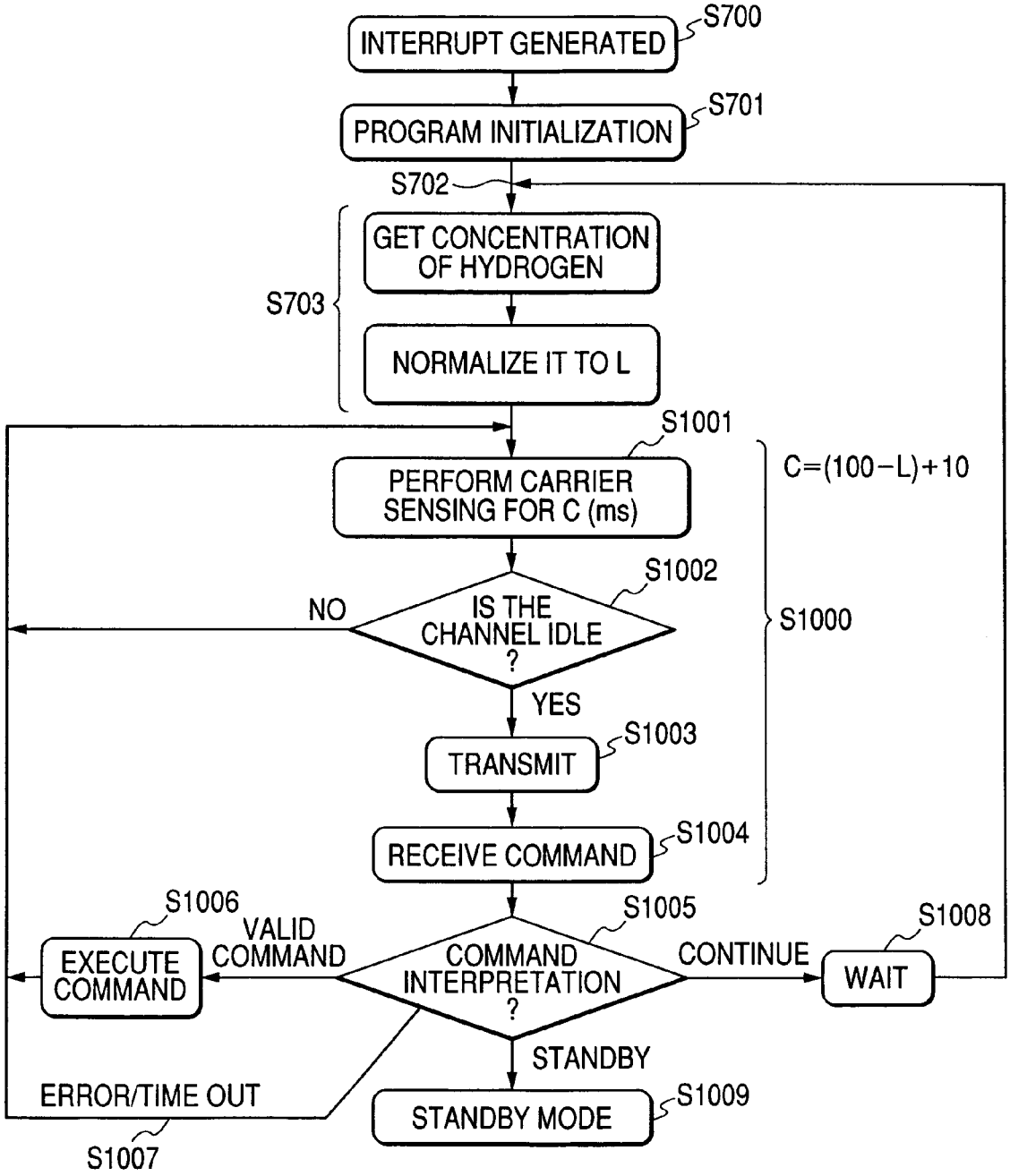
FIG. 11 shows a flowchart of operation of a node that controls transmission, according to another embodiment of the present invention.

FIG. 11 shows a flowchart of operation of a node that controls transmission, using only hydrogen concentration levels. The steps except those denoted by S1000 are the same as described in FIG. 7 and, therefore, their explanation is not repeated.

A part of the procedure denoted by S1000 (S1001~S1004) is a general CSMA/CA control flow that is used for wireless LANs and the like. Only difference is that carrier sensing time C changes according to the obtained hydrogen concentration level in step S1001. Carrier sensing time C is set smaller for nodes detecting higher concentration hydrogen.

By way of example, carrier sensing time C is given by an equation C=(100−L)+10. In this way, at nodes detecting higher concentration hydrogen, wait time is shorter. With this, information from nodes detecting higher concentration hydrogen can be preferentially transmitted to the access point without using the channel busy ratio which is applied in first embodiment.

Second embodiment is a means that is effective for a hydrogen gas station where the number of hydrogen sensors installed is fewer than in first embodiment and the channel has a sufficient capacity.

In second embodiment as well, gas leakage in a hydrogen gas station is detected quickly and proper communication in which priority is given to more urgent transmissions can be ensured. Consequently, hydrogen can be utilized more safely and hydrogen gas stations can be installed in an urban area or the like where high safety is required.

The present invention can be similarly applied to hydrogen gas stations oriented to hydrogen gas vehicles equipped with an internal combustion engine in which hydrogen gas from the high-pressure container storing the hydrogen gas is combusted, instead of fuel-cell vehicles.

The present invention is not limited to hydrogen gas stations, and can be applied broadly to installations that handle gas like hydrogen and natural gas, which will diffuse very quickly and may explode if leakage is neglected.

What is claimed is:

1. A wireless terminal having a sensor, a microcomputer, and a wireless transceiver and provided with a transmitting function to transmit outward gas concentration detected by said sensor through said wireless transceiver, said wireless terminal including:

a transmission control unit to control a transmission process of said gas concentration through said wireless transceiver over a communication channel, according to the level of said gas concentration detected at the wireless terminal, wherein, when transmitting said gas concentration through said wireless transceiver, said wireless terminal controls the transmission process, according to the level of said gas concentration and the busy ratio of the communication channel over which the wireless terminal will transmit.

2. The wireless terminal according to claim 1, wherein if said gas concentration is high, a high chance of using said communication channel is given to the wireless terminal.

3. The wireless terminal according to claim 1, wherein said gas concentration is less than a predetermined value, said transmission is deferred.

4. The wireless terminal according to claim 3, wherein if said gas concentration is high, a high chance of using said communication channel is given to the wireless terminal.

5. The wireless terminal according to claim 1, wherein, when transmitting said gas concentration through said wireless transceiver, if the busy ratio of said communication channel is high and said gas concentration is low, said wireless terminal defers the transmission or performs the transmission after waiting for a predetermined period of time.

6. The wireless terminal according to claim 1, wherein said sensor is a hydrogen sensor and said wireless terminal has a criterion pattern for transmission decision by which it determines said transmission process, wherein said criterion pattern for transmission decision is defined by a relation between channel busy ratio R and hydrogen concentration level L and configured such that, the higher said hydrogen concentration level, preferential use of said communication channel will be allowed for up to a high value range of channel busy ratio R.

7. The wireless terminal according to claim 1:

wherein said wireless terminal detects whether a radio frequency band is being used by carrier sensing, and wherein said sensor is a hydrogen sensor and control is performed so that the higher the hydrogen concentration level, the shorter the carrier sensing time will be.

* * * * *